US009445476B2

(12) United States Patent
Rodriguez et al.

(10) Patent No.: US 9,445,476 B2
(45) Date of Patent: Sep. 13, 2016

(54) SYSTEM AND METHOD FOR CONTROLLING LED SEGMENTS TO PROVIDE LIGHTING EFFECTS

(71) Applicant: ABL IP Holding LLC, Decatur, GA (US)

(72) Inventors: Yan Rodriguez, Suwanee, GA (US); Michael Bruce, Atlanta, GA (US); Mark Anthony Hand, Covington, GA (US); Philip Sieczkowski, Lawrenceville, GA (US)

(73) Assignee: ABL IP Holding LLC, Decatur, GA (US)

( * ) Notice: Subject to any disclaimer, the term of this patent is extended or adjusted under 35 U.S.C. 154(b) by 0 days.

(21) Appl. No.: 15/011,749

(22) Filed: Feb. 1, 2016

(65) Prior Publication Data

US 2016/0165696 A1 Jun. 9, 2016

Related U.S. Application Data

(63) Continuation of application No. 13/840,590, filed on Mar. 15, 2013.

(60) Provisional application No. 61/636,924, filed on Apr. 23, 2012.

(51) Int. Cl.
*H05B 33/08* (2006.01)

(52) U.S. Cl.
CPC ..... *H05B 33/0866* (2013.01); *H05B 33/083* (2013.01); *H05B 33/0851* (2013.01)

(58) Field of Classification Search
USPC .... 315/122, 185 R, 200, 201, 291, 294, 307
See application file for complete search history.

(56) References Cited

U.S. PATENT DOCUMENTS

| | | | |
|---|---|---|---|
| 6,168,299 | B1 | 1/2001 | Yan |
| 7,649,322 | B2 | 1/2010 | Neuman et al. |
| 7,764,028 | B2 | 7/2010 | Mariyama et al. |
| 7,959,332 | B2 | 6/2011 | Tickner et al. |
| 8,096,686 | B2 | 1/2012 | Wilcox |
| 8,118,441 | B2 | 2/2012 | Hessling |

(Continued)

FOREIGN PATENT DOCUMENTS

| | | |
|---|---|---|
| CA | 2767985 | 7/2010 |
| KR | 2020100009895 | 10/2010 |

OTHER PUBLICATIONS

Non-Final Office Action for U.S. Appl. No. 13/840,590, mailed Apr. 2, 2015, 14 pages.

(Continued)

*Primary Examiner* — Thai Pham
(74) *Attorney, Agent, or Firm* — Kilpatrick Townsend & Stockton, LLP

(57) ABSTRACT

A single board light engine includes an AC to AC step driver that selectively powers multiple LED segments by controlling tap points between the LED segments as the input voltage goes from zero crossover to maximum voltage and returns to zero crossover. The step driver may power a first LED segment, a second LED segment, both the first and second LED segments, or none of the LED segments depending upon the input voltage level. The LEDs within an LED segment may share a characteristic that differs from a characteristic shared by LEDs in another segment, which allows the LED fixture to provide a variety of lighting effects.

19 Claims, 6 Drawing Sheets

(56) References Cited

U.S. PATENT DOCUMENTS

| | | | | |
|---|---|---|---|---|
| 2008/0094000 | A1 | 4/2008 | Yamamoto et al. | |
| 2008/0258643 | A1 | 10/2008 | Cheng et al. | |
| 2009/0195186 | A1 | 8/2009 | Guest et al. | |
| 2010/0061108 | A1 | 3/2010 | Zhang et al. | |
| 2010/0110699 | A1 | 5/2010 | Chou | |
| 2010/0148672 | A1 | 6/2010 | Hopper | |
| 2010/0308739 | A1 | 12/2010 | Shteynberg et al. | |
| 2011/0050125 | A1 | 3/2011 | Medendorp, Jr. et al. | |
| 2011/0074292 | A1 | 3/2011 | Maehara | |
| 2011/0075414 | A1 | 3/2011 | Van De Ven et al. | |
| 2011/0075422 | A1 | 3/2011 | Van De Ven et al. | |
| 2011/0101883 | A1 | 5/2011 | Grajcar | |
| 2011/0170289 | A1 | 7/2011 | Allen et al. | |
| 2011/0182065 | A1 | 7/2011 | Negley et al. | |
| 2011/0193467 | A1* | 8/2011 | Grajcar | F21S 4/28 313/113 |
| 2011/0199753 | A1 | 8/2011 | Ramer et al. | |
| 2011/0227489 | A1* | 9/2011 | Huynh | H05B 33/083 315/185 R |
| 2011/0241551 | A1* | 10/2011 | McRae | H05B 33/0806 315/130 |
| 2011/0316440 | A1 | 12/2011 | Leshniak | |
| 2012/0020092 | A1 | 1/2012 | Bailey | |
| 2012/0056556 | A1 | 3/2012 | Laski et al. | |
| 2013/0278163 | A1 | 10/2013 | Rodriguez et al. | |

OTHER PUBLICATIONS

Final Office Action for U.S. Appl. No. 13/840,590, mailed Sep. 17, 2015, 15 pages.

Notice of Allowance for U.S. Appl. No. 13/840,590, mailed Jan. 15, 2016, 12 pages.

Office Action for Canadian Application No. CA 2,809,853, mailed Oct. 2, 2014, 2 Pages.

Office Action for Canadian Application No. CA 2,809,853, mailed Oct. 5, 2015, 4 pages.

Extended European Search Report for European Application No. EP 13164944.4, Jul. 24, 2015, 7 pages.

Juno Lighting Group, G1.8.4, 6" IC LED Retrofit WARMDIM Downlight Trim, specification, rev Oct. 2012.

Notice of Allowance for U.S. Appl. No. 13/840,590, mailed Mar. 7, 2016, 5 pages.

* cited by examiner

SYSTEM AND METHOD FOR CONTROLLING LED SEGMENTS TO PROVIDE LIGHTING EFFECTS

RELATED APPLICATION

This application is a continuation of U.S. patent application Ser. No. 13/840,590 filed on Mar. 15, 2013, now allowed, which application claims priority to and the benefit of U.S. Application No. 61/636,924 filed Apr. 23, 2012 for LED Fixtures and Methods of Controlling LEDs within a Fixture, both of which are incorporated herein by reference.

FIELD OF THE INVENTION

The present invention is related to LED fixtures and more particularly to controlling LED segments having different characteristics to provide certain lighting effects.

BACKGROUND

When LEDs (light emitting diodes) replace traditional light sources, such as incandescent sources, there is often a desire to have the LEDs produce light and lighting effects similar to those produced by traditional light sources. Dimming is one example of this. An incandescent source is a single source point which begins to dim up from the center. As the brightness increases the single source point becomes brighter giving the effect of center to edge brightness. In contrast to an incandescent fixture, LED fixtures typically light up from multiple source points. A typical LED fixture includes an AC to DC driver and a number of LEDs arranged in parallel and serial strings. As the driver increases its output current, all of the LEDs begin to emit photons simultaneously and increase in unison until full brightness is achieved.

In order to achieve center to edge brightness in LED fixtures some fixtures use multiple output drivers to control the output in stages so that first the center LED string, then the edge LED strings are lit. However, a fixture with multiple output drivers and the associated controls needed to control the drivers result in a complex and costly design. Thus, there is a need for a more cost effective approach to provide center to edge brightness in an LED fixture.

Another difference between incandescent sources and LED sources is the way the color temperature changes as the light level increases. Incandescent sources generate light by the glowing of a metal, such as tungsten. The color temperature of the glowing element is low at low light levels and progressively increases as the light level increases. LEDs do not change color temperature in the same manner as an incandescent source. In order to achieve the color temperature change of an incandescent source, some LED fixtures use multiple output drivers and controls to drive LEDs of different color temperatures at different times. However, this approach is both costly and complex. Thus, there is a need for a more cost effective approach for providing color temperature change as light levels increase in an LED fixture.

SUMMARY

One aspect of the present invention provides a single board light engine that includes driver electronics and multiple LED segments. The driver electronics include a step driver that selectively powers the LED segments by controlling one or more tap points as the AC waveform goes from zero crossover to maximum voltage. Between the zero crossover and a first voltage level, the step driver controls all of the LED segments so that they are off. When the voltage level reaches the first voltage level, the step driver configures the LED segments so that the first LED segment is powered. As the voltage level continues to rise, the first LED segment remains powered and when the voltage level reaches the second voltage level, the step driver configures the LED segments so that the first and second LED segments are powered. This continues for additional voltage levels and LED segments, if needed. Once the voltage level begins to fall the step driver controls the LED segments so that an LED segments is turned off as the voltage drops below each voltage level. This sequence repeats for each subsequent half cycle. Having a single board for both the driver electronics and the LED segments provides a solution that is especially useful in downlight applications.

The LEDs within an LED segment may share a characteristic that differs from a characteristic shared by LEDs in another segment. Examples of these characteristics include their position on the board, their color temperature, their color, and/or their optics or refractors. Some of the characteristics, such as position on the board and color temperature, allow an LED fixture to emulate lighting effects produced by an incandescent fixture. When the LED segments have different positions on the board, then the LED fixture may provide center to edge brightness. When the LED segments have different color temperatures, then the LED fixture may provide dim to warm color temperature (warm color temperature at low light levels and hot color temperature at high light levels). Other characteristics provide lighting effects that are not provided by an incandescent fixture, such as different colors at different dimming levels and different light distributions at different dimming levels.

Other features, advantages, and objects of the present invention will be apparent to those skilled in the art with reference to the remaining text and drawings of this application.

DETAILED DESCRIPTION

The present invention provides a single board light engine that includes driver electronics and multiple LED segments. The driver electronics include an AC to AC step driver that selectively powers the LED segments by controlling tap points between the LED segments as the AC waveform goes from zero crossover to maximum voltage and returns to zero crossover. The step driver may power a first LED segment, a second LED segment, both the first and second LED segments, or none of the LED segments depending upon the voltage level. The LEDs within an LED segment may share a characteristic that differs from a characteristic shared by LEDs in another segment. When the LED segments have different positions on the board, then the LED fixture may provide center to edge brightness. When the LED segments have different color temperatures, then the LED fixture may provide dim to warm color temperature (warm color temperature at low light levels and hot color temperature at high light levels). When the LED segments have different colors, then the LED fixture may provide different colors at different dimming levels. When the LED segments have different light distributions, then the LED fixture may provide different light distributions at different dimming levels.

Single Board Light Engine

One aspect of the present invention provides a single board light engine that includes driver electronics and multiple LED segments. The driver electronics use an AC to AC driver instead of the traditional AC to DC driver. The AC to AC driver selectively powers the LED segments by controlling one or more tap points between the LED segments as the AC waveform goes from zero crossover to maximum voltage. This allows the LED segments to light up at 120 Hz (120V AC 60 Hz rectified) in sync with the traditional household AC service. Examples of suitable AC to AC drivers include, but are not limited to, the LED step driver, CL880, offered by Supertex Inc. or the LED step driver, EXC100, offered by Exclara, Inc.

Figure 1:
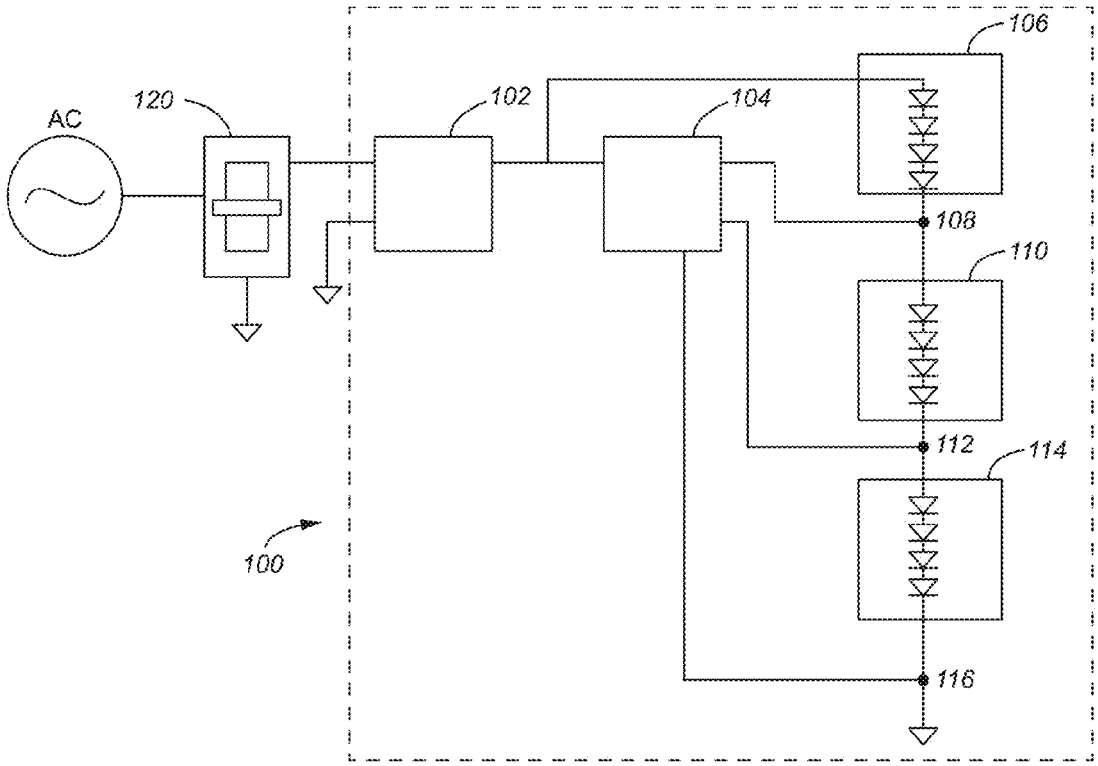
FIG. 1 is a block diagram illustrating an exemplary LED light engine.

FIG. 1 illustrates the main components on the light engine, as well as the connection of an optional dimmer 120 to the light engine 100. The light engine 100 includes a rectifier 102 a step driver 104, and multiple LED segments 106, 110, 114. Although FIG. 1 shows three LED segments each with 4 LEDs, there may be a different number of LED segments and a different number of LEDs within each segment in other designs. The step driver 104 controls tap points 108, 112, 116 to control which LED segments are powered. For example, the step driver may control the tap points so that only the first LED segment 106 is powered, the first LED segment 106 and the second LED segment 110 are powered, all three LED segments 106, 110, 114 are powered, or none of the LED segments are powered.

Figure 2:
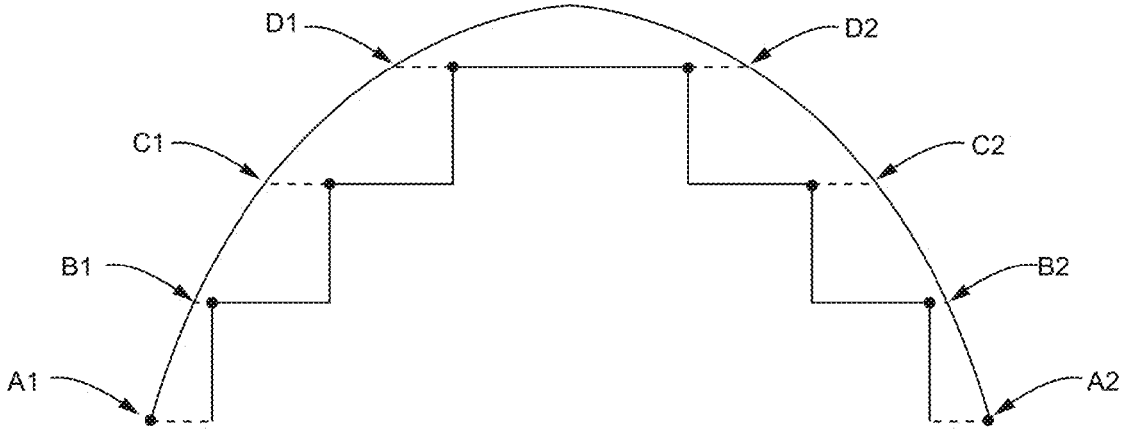
FIG. 2 is a waveform illustrating exemplary voltage levels.

FIG. 2 illustrates a half cycle of the rectified line voltage that is provided to the step driver. Points A1 and A2 represent the zero crossover, points B1 and B2 represent the first voltage level, points C1 and C2 represent the second voltage level, and points D1 and D2 represent the third voltage level. In one implementation, the first voltage level is approximately 60V, the second voltage level is approximately 75V, and the third voltage level is approximately 100V. The number and voltage of the voltage levels may differ in other designs. The steps inside the waveform illustrate how the step driver controls the three LED segments shown in FIG. 1. Between the zero crossover and point A1, the step driver controls all of the LED segments so that they are off. When the voltage level reaches point B1, the step driver configures the LED segments so that the first LED segment is powered. As the voltage level continues to rise, the first LED segment remains powered and when the voltage level reaches point C1, the step driver configures the LED segments so that the first and second LED segments are powered. As the voltage continues to rise, the first and second LED segments remain powered and when the voltage level reaches point D1, the step driver configures the LED segments so that the first, second, and third LED segments are powered. The three LED segments remain powered until the voltage level falls below point D2. Once the voltage level falls below point D2, the step driver configures the LED segments so that the third LED segment is off and the first and second LED segments remain powered. Once the voltage level falls below point C2, the step driver configures the LED segments so that the second and third LED drivers are off and only the first LED segment remains powered. Once the voltage level falls below point B2, the step driver turns the first LED segment off so that none of the LED segments are powered. This sequence repeats for each subsequent half cycle.

Figure 3:
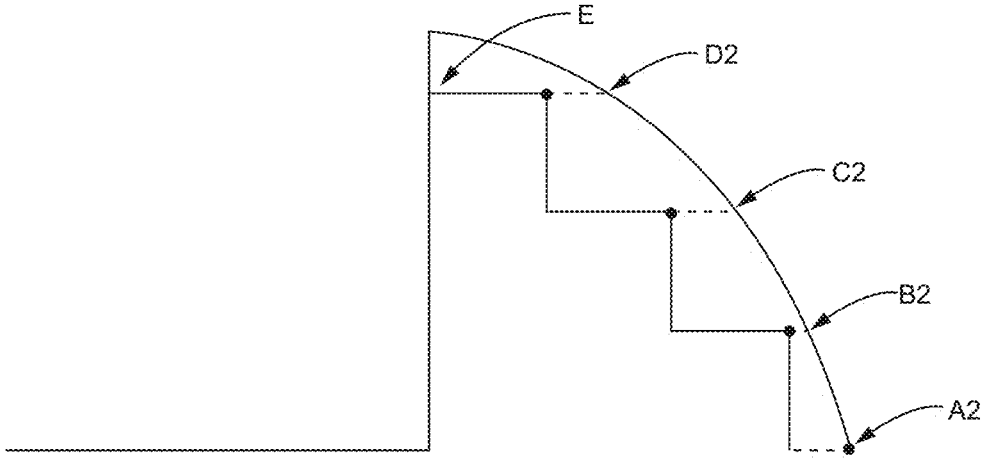
FIG. 3 is a waveform illustrating an exemplary dimming level.

As shown in FIG. 1, an optional dimmer 120 may be connected to the light engine. The dimmer may be a leading edge or a trailing edge dimmer. If a leading or a trailing edge dimmer is used, then the step driver controls the LED segments according to the proportional amount of the AC waveform present at the driver. For example, if the dimmer is a leading edge dimmer set for 90% dimming, then the step driver receives only the last 10% of the waveform shown in FIG. 2 and if the dimmer is a leading edge dimmer set for 50% dimming, then the step driver receives only the second half of the waveform shown in FIG. 2. FIG. 3 illustrates the case of 50% dimming where the step driver turns on the first, second and third LED segments at point E, then once the voltage level falls below point D2, the step driver configures the LED segments so that the third LED segment is off and the first and second LED segments remain powered. Once the voltage level falls below point C2, the step driver configures the LED segments so that the second and third LED drivers are off and only the first LED segment remains powered. Once the voltage level falls below point B2, the first LED segment is turned off so that none of the LED segments are powered.

Figure 4:
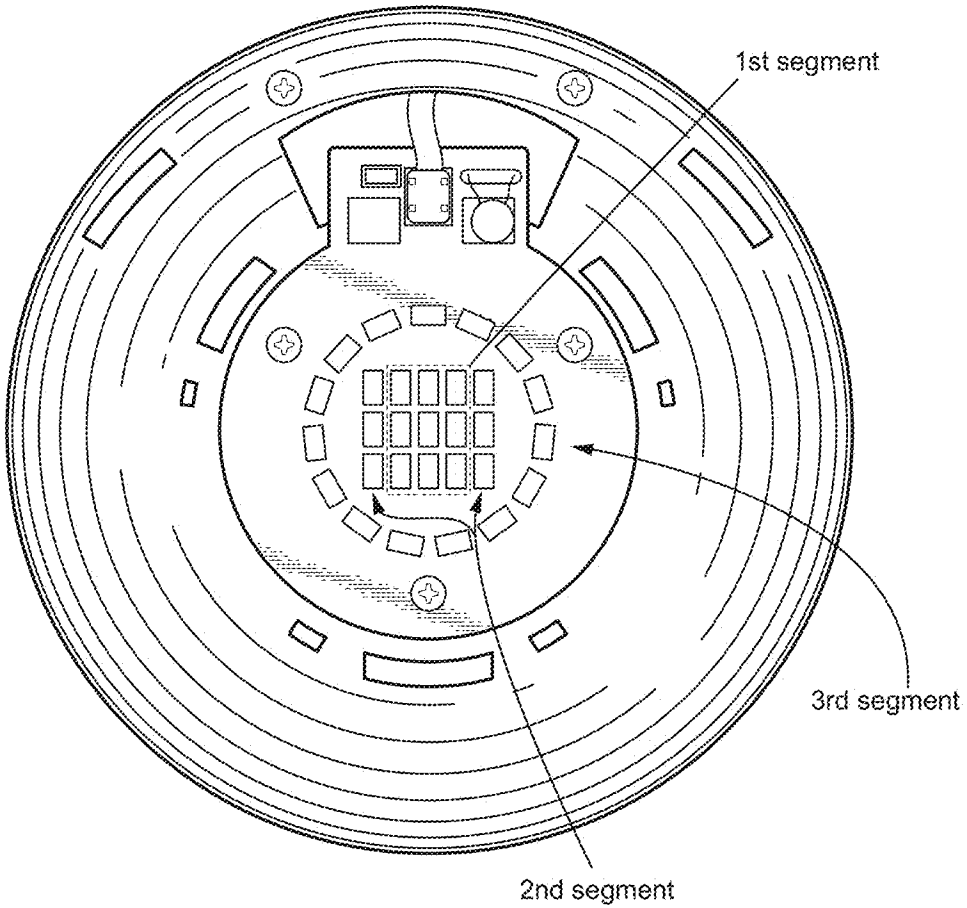
FIG. 4 is a block diagram illustrating an exemplary arrangement of LED segments for center to edge brightness.
Figure 5:
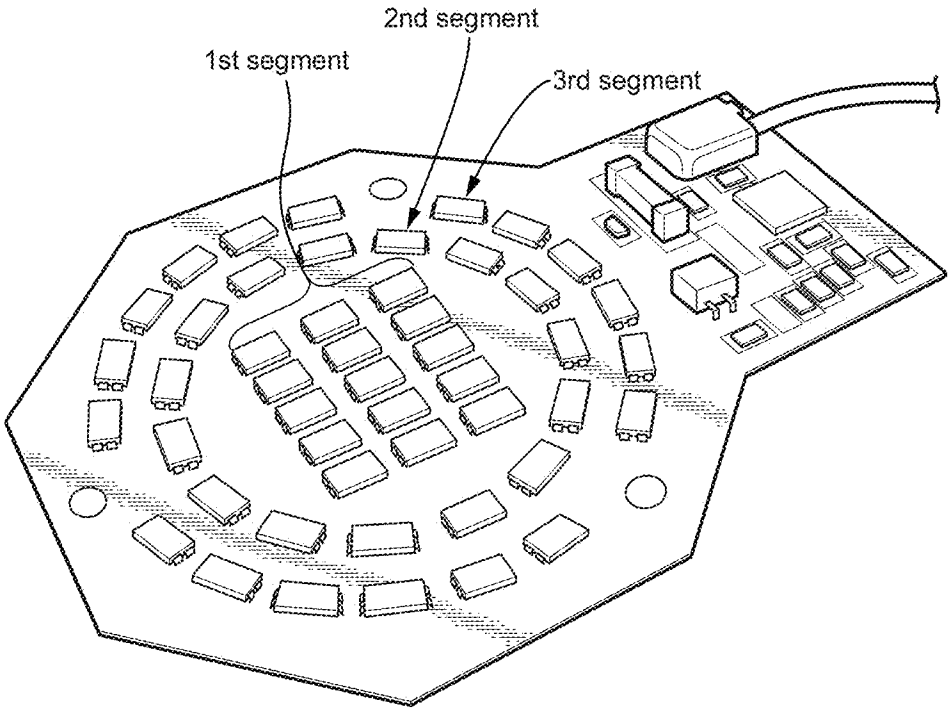
FIG. 5 is a block diagram illustrating another exemplary arrangement of LED segments for center to edge brightness.
Figure 6:
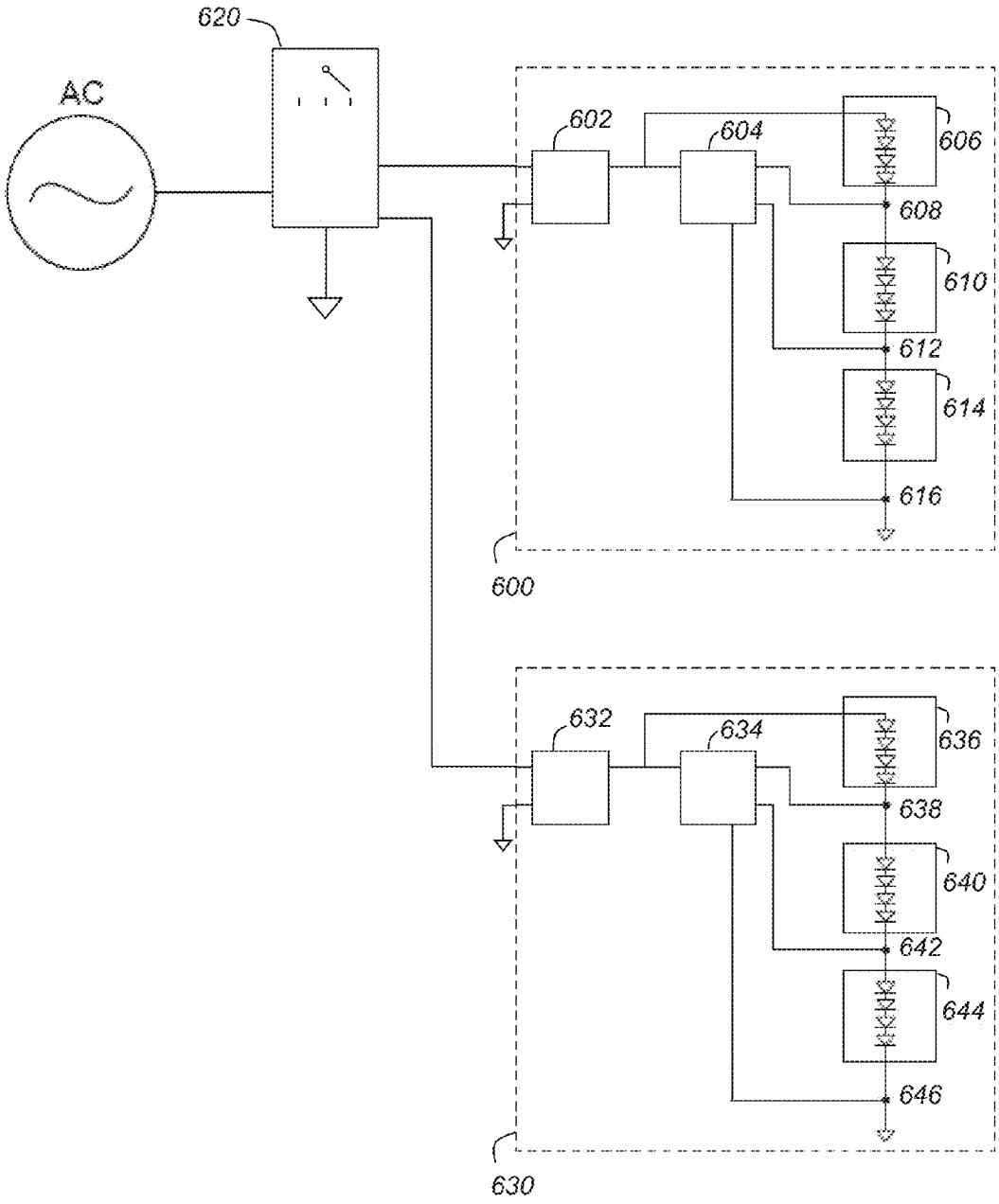
FIG. 6 is a block diagram illustrating an exemplary system with multiple LED light engines.

Given the relatively low component count needed to implement a light engine, such as that shown in FIG. 1, it is possible to arrange the rectifier, the step driver and the multiple LED segments on a single board. Exemplary board layouts are shown in FIGS. 4 and 5. A single board light engine significantly reduces complexity and cost. A single board light engine may be used in a recessed downlight fixtures or may be used to retrofit an existing recessed downlight fixture to upgrade it from a conventional light source fixture to an LED light source fixture. One advantage of using a single board light engine in a downlight fixture include increasing the height of the mixing chamber (space between the LEDs and the lens or the ceiling), which increases the shielding angle (the angle between the ceiling and a line extending from the board through a point on the opposite edge of the mixing chamber. Another advantage is that it supports a much shallower fixture.

In some implementations, a separating cone is added to the mixing chamber to separate the driver side of the board from the LED side of the board to avoid the production of any unwanted shadows or artifacts.

Since the duty cycle of the LED segments vary, the amount of heat that needs to be dissipated for the different LED segments also varies. In the above example, the first LED segment has the longest duty cycle and requires more heat dissipation than the other LED segments. If a heat sink material is used to dissipate heat, then more heat sink material may be placed in the area of the first LED segment, than in the area of the second or third LED segment. Similarly, there may be more heat sink material in the area of the second LED segment than in the area of the third LED segment. In some instances, the amount of heat sink material in the area of an LED segment may be proportional to the segment's duty cycle.

In some implementations the LEDs within a segment share a characteristic that differs from a characteristic shared by LEDs in another segment. Examples of these characteristics include their position on the board, their color temperature, their color, and/or their optics or refractors. These characteristics may be used to achieve lighting effects that emulate those produced by a traditional lighting source or to provide additional lighting effects.

Center to Edge Brightness

The LED segments may be positioned on the board to provide center to edge brightness to emulate the operation of an incandescent source. In one example with three LED segments, the first LED segment is located at approximately the center of the board, the second LED segment at least partially surrounds the first LED segment and is located further out from the center, and the third LED segment at least partially surrounds the second LED segment and is located furthest from the center. FIGS. 4 and 5 illustrate different arrangements of the first, second and third LED segments that provide center to edge brightness. In FIG. 4 the first LED segment includes nine LEDs arranged in the center of the board. The second LED segment includes six LEDs, with three LEDs arranged along one side of the first LED segment and three LEDs arranged along the opposite side of the first LED segment. The third LED segment includes fifteen LEDs arranged in a circle around the first and second LED segments. In FIG. 5 the first LED segment includes fifteen LEDs arranged in the center of the board, the second LED segment includes fifteen LEDs arranged in a circle around the first LED segment, and the third LED segment includes eighteen LEDs arranged in a circle around the first and second LED segments. Other numbers of LEDs in each segment, as well as other arrangements are also possible, as will be apparent to one skilled in the art.

When the fixture is initially powered, the step driver controls all of the LED segments so that they are off until it sees the first voltage level, then the step driver powers the first LED segment, which is located in approximately the center of the board.

When the step driver sees the second voltage level, then the step driver powers both the first and second LED segments, which expands the light from the center outwards. When the step driver sees the third voltage level, then the step driver powers all three LED segments, which expand the light further outwards. In this manner, the LED fixture may provide center to edge brightness at power-on, which is similar to that provided by an incandescent fixture.

The same arrangement that provides center to edge brightness at power-on may also provide center to edge brightness in connection with dimming. As discussed above, the shape of the AC waveform is controlled by the dimmer. When the LED segments are arranged with the first LED segment in the center of the board, then as the light level increases, the LED segments power on in a pattern extending from the center of the board towards the edge of the board to emulate a traditional incandescent source.

Color Temperature

In addition to or as an alternative to the positioning of the LED segments described above, the LEDs in each of the LED segments may have a different color temperature so that the color temperature of the fixture changes as the fixture is dimmed up or down to emulate the color temperature change of an incandescent source as its light output level increases or decreases. White color LEDs are typically available in color temperatures ranging from approximately 2700K (warm) up to 5000K (hot).

In one implementation, the first LED segment includes warm color LEDs, such as 2700K and the second and any subsequent LED segments use higher temperature LEDs, such as 3000K, 3500K or 4000K. The effect of the "mixing" of different color temperature LEDs in the fixture changes the perceived color temperature from warm to hot as the light level increases and from hot to warm as the light level decreases.

Color

The different LED segments may use different color LEDs. For example, an outer segment may have a different color than one or more of the inner segments. One LED segment may have white LEDs and one or more other LED segments may have non-white or colored LEDs. Mixing LED segments with different colors may create color variations over the dimming range. For example, a fixture may have a first LED segment with red or other narrow-wave length LEDs and a second LED segment with white LEDs. The fixture may dim from white light down to red light and may be used in a planetarium or photo lab.

Optical Effects

The different LED segments may be associated with different optical features, such as different optics and refractors, to provide a variable photometric distribution over the dimming range. One example fixture includes one LED segment with BR distribution and one LED segment with PAR distribution. Another example fixture includes one LED segment with an ambient distribution and one LED segment with a wall wash distribution. In a fixture where the LED segments have different light distributions, the fixture will provide the light distribution of the first LED segment at low light levels and a mixed light distribution at higher light levels.

In yet another example, the first LED segment is associated with an optic that provides a design or logo so that the design or logo is most visible at a high dimming percentage.

Discrete LEDs and COB LEDs

The LED segments may use multiple discrete LEDs or may use chip on board (COB) LEDs. If COB LEDs are used, then the COB device may include multiple LED segments and may provide connections for the tap points. The LED segments may use various types of LEDs including, but not limited to, 3V, and 6V LEDs. Different LED types can be mixed within the same fixture.

Multiple Boards

A single board light engine 600 may be combined with a second single board light engine 630 to provide additional dimming granularity. If two single board light engines are combined, then a three-position switch 620 may be used instead of a dimmer. When the switch is in a first position, the first board is powered and the second board is not. When the switch is in a second position, each board is powered for a half cycle. During the first half cycle the first board is powered and the second board is not and during the second half cycle the second board is powered and the first board is not. When the switch is in third position, the second board is powered and the first board is not. The boards operate in a manner similar to that discussed above in connection with FIGS. 1 and 2 during the time they are powered.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. For example, although some of the examples describe a downlight fixture, many other types of fixtures including, but not limited to, ceiling fixtures and wall mount fixtures can also be used. Accordingly, the present invention is not limited to the embodiments described above or depicted in the drawings, and various embodiments and modifications can be made without departing from the scope of the invention.

What is claimed is:

1. A single board light engine comprising:

an LED step driver having an adjustable input connected to a rectified line voltage;

a first LED segment located at a central location on the single board light engine, wherein the first LED segment comprises a first plurality of LEDs arranged at the central location;

a second LED segment located on the single board light engine, wherein the second LED segment comprises a second plurality of LEDs and a first portion of the second plurality of LEDs is arranged on a first side of the first LED segment and a second portion of the second plurality of LEDs is arranged on a second side of the first LED segment;

a first tap point between a last LED of the first LED segment and a first LED of the second LED segment; and a second tap point after a last LED of the second LED segment, wherein the LED step driver controls the first tap point and the second tap point such that while the adjustable input to the LED step driver is below a first voltage level the first and second LED segments are unpowered, while the adjustable input to the LED step driver is between the first voltage level and a second voltage level the first LED segment is powered and the second LED segment is unpowered to produce a first lighting effect of center brightness, and while the adjustable input to the LED step driver is above the second voltage level the first and second LED segments are powered to produce a second lighting effect of expanding the center brightness outwards, and wherein the second voltage level is higher than the first voltage level.

2. The single board light engine of claim 1, wherein the first LED segment has a first color and the second LED segment has a second color, and wherein the first lighting effect is further comprised of the first color and the second lighting effect is further comprised of a blend of the first color and the second color.

3. The single board light engine of claim 1, wherein the first LED segment has a first color temperature, the second LED segment has a second color temperature, and the first color temperature is lower than the second color temperature, and wherein the first lighting effect is further comprised of the first color temperature and the second lighting effect is further comprised of a color temperature between the first color temperature and the second color temperature.

4. The single board light engine of claim 1, further comprising:

a first optical element that is associated with the first LED segment and provides a first light distribution, and a second optical element that is associated with the second LED segment and provides a second light distribution;

wherein the first lighting effect is further comprised of the first light distribution and the second lighting effect is further comprised of a light distribution based on a combination of the first light distribution and the second light distribution.

5. The single board light engine of claim 1, further comprising:

a third LED segment comprising a third plurality of LEDs, wherein the third LED segment at least partially surrounds the first and second LED segments; and a third tap point after a last LED of the third LED segment, wherein the second tap point is before a first LED of the third LED segment;

wherein the LED step driver further controls the third tap point such that while the adjustable input to the LED step driver is below a third voltage level the third LED segment is unpowered, and while the adjustable input to the LED step driver is above a third voltage level the first, second, and third LED segments are powered to produce a third lighting effect of expanding the center brightness further outwards, and wherein the third voltage level is higher than the first and second voltage levels.

6. A single board light engine comprising:

an LED step driver having an adjustable input connected to a rectified line voltage;

a first LED segment comprising a first plurality of LEDs wherein the first LED segment is located at a central location on the single board light engine;

a second LED segment comprising a second plurality of LEDs, wherein the second LED segment is located adjacent to the first LED segment on the single board light engine, and the second LED segment at least partially surrounds the first LED segment;

a first tap point between a last LED of the first LED segment and a first LED of the second LED segment; and a second tap point after a last LED of the second LED segment, wherein the LED step driver controls the first tap point and the second tap point such that while the adjustable input to the LED step driver is below a first voltage level the first and second LED segments are unpowered, while the adjustable input to the LED step driver is between the first voltage level and a second voltage level the first LED segment is powered and the second LED segment is unpowered to produce a first lighting effect of center brightness, and while the adjustable input to the LED step driver is above the second voltage level the first and second LED segments are powered to produce a second lighting effect of expanding the center brightness outwards, and wherein the second voltage level is higher than the first voltage level.

7. The single board light engine of claim 6, wherein the first plurality of LEDs is arranged at the central location on the single board light engine, and a first portion of the second plurality of LEDs is arranged on a first side of the first LED segment and a second portion of the second plurality of LEDs is arranged on a second side of the first LED segment.

8. The single board light engine of claim 6, wherein the first LED segment has a first color and the second LED segment has a second color, and wherein the first lighting effect is further comprised of the first color and the second lighting effect is further comprised of a blend of the first color and the second color.

9. The single board light engine of claim 6, wherein the first LED segment has a first color temperature, the second LED segment has a second color temperature, and the first color temperature is lower than the second color temperature, and wherein the first lighting effect is further comprised of the first color temperature and the second lighting effect is further comprised of a color temperature between the first color temperature and the second color temperature.

10. The single board light engine of claim 6, further comprising:

a first optical element that is associated with the first LED segment and provides a first light distribution, and a second optical element that is associated with the second LED segment and provides a second light distribution;

wherein the first lighting effect is further comprised of the first light distribution and the second lighting effect is further comprised of a light distribution based on a combination of the first light distribution and the second light distribution.

11. The single board light engine of claim 6, wherein the first plurality of LEDs of the first LED segment includes discrete LEDs.

12. The single board light engine of claim 6, wherein the first plurality of LEDs of the first LED segment includes chip-on-board (COB) LEDs.

13. The single board light engine of claim 6, wherein the single board light engine is part of a downlight.

14. The single board light engine of claim 6, further comprising:

a third LED segment comprising a third plurality of LEDs, wherein the third LED segment is located adjacent to the second LED segment on the single board light engine, and the third LED segment is farthest from the central location and at least partially surrounds the second LED segment; and a third tap point after a last LED of the third LED segment, wherein the second tap point is before a first LED of the third LED segment;

wherein the LED step driver further controls the third tap point such that while the adjustable input to the LED step driver is below a third voltage level the third LED segment is unpowered, and when the adjustable input to the LED step driver is above a third voltage level the first, second, and third LED segments are powered to produce a third lighting effect of expanding the center brightness further outwards, and wherein the third voltage level is higher than the first and second voltage levels.

15. A method of controlling a plurality of LED segments, comprising:

determining an input voltage level;

when the input voltage level is below a first voltage level, controlling the LED segments so that none of the LED segments are powered;

when the input voltage level is between a first voltage level and a second voltage level, controlling the LED segments so that a first LED segment located at a central location on a board is powered and a second LED segment located adjacent to and partially surrounding the first LED segment is unpowered to produce a first lighting effect of center brightness;

when the input voltage level is above the second voltage level, controlling the LED segments so that the first and second LED segments are powered to produce a second lighting effect of expanding the center brightness outwards;

wherein the second voltage level is higher than the first voltage level.

16. The method of claim 15, wherein the first LED segment comprises a first plurality of LEDs arranged at the central location on the board, and the second LED segment comprises a second plurality of LEDs arranged such that a first portion of the second plurality of LEDs is arranged on a first side of the first LED segment and a second portion of the second plurality of LEDs is arranged on a second side of the first LED segment.

17. The method of claim 15, wherein the first LED segment has a first color and the second LED segment has a second color, and wherein the first lighting effect is further comprised of the first color and the second lighting effect is further comprised of a blend of the first color and the second color.

18. The method of claim 15, wherein the first LED segment has a first color temperature, the second LED segment has a second color temperature, and the first color temperature is lower than the second color temperature, and wherein the first lighting effect is further comprised of a first color temperature and the second lighting effect is further comprised of a color temperature between the first color temperature and the second color temperature.

19. The method of claim 15, wherein a first optical element is associated with the first LED segment and provides a first light distribution and a second optical element is associated with the second LED segment and provides a second light distribution, and wherein the first lighting effect is further comprised of the first light distribution and the second lighting effect is further comprised of a light distribution based on a combination of the first light distribution and the second light distribution.

* * * * *